United States Patent [19]

Miller

[11] 3,932,005

[45] Jan. 13, 1976

[54] ELASTOMERIC RAILWAY CAR WITH SIDE BEARING

[75] Inventor: Henry F. Miller, Clifton, N.J.

[73] Assignee: Uniroyal Inc., New York, N.Y.

[22] Filed: May 10, 1974

[21] Appl. No.: 468,848

[52] U.S. Cl. ..... 308/138; 105/199 CB; 267/3

[51] Int. Cl.[2]... B61F 5/14; B61F 5/24; F16C 17/04; F16C 27/02

[58] Field of Search ..... 105/199 CB; 267/3; 308/138

[56] References Cited

UNITED STATES PATENTS

| | | | |
|---|---|---|---|
| 2,301,372 | 11/1942 | Cottrell | 308/138 |
| 2,327,954 | 8/1943 | Barrows et al. | 308/138 |
| 3,556,503 | 1/1971 | Van Moss, Jr. | 267/3 |
| 3,628,464 | 12/1971 | Van Moss, Jr. | 308/138 X |
| 3,719,154 | 3/1973 | Reynolds | 267/3 |
| 3,796,167 | 3/1974 | Van Moss, Jr. | 308/138 X |

*Primary Examiner*—Robert S. Ward, Jr.
*Assistant Examiner*—Howard Beltran
*Attorney, Agent, or Firm*—Charles A. Blank, Esq.

[57] ABSTRACT

A side bearing for railroad cars having a body portion of hard elastomeric material and a base for attachment to the truck bolster of a railroad car. The upper bearing surface when the bearing is unloaded is flat, outwardly convex, or outwardly concave, providing the bearing with strain distribution characteristics under load that minimize heat build-up and permanent deformation of the side bearing.

12 Claims, 11 Drawing Figures

INTERNAL RADIAL STRAIN DISTRIBUTION
@ 6000 LBS. STATIC LOAD

INTERNAL TANGENTIAL STRAIN DISTRIBUTION @ 6000 LBS. STATIC LOAD

INTERNAL AXIAL STRAIN DISTRIBUTION @ 6000 LBS. STATIC LOAD

ELASTOMERIC RAILWAY CAR WITH SIDE BEARING

BACKGROUND OF THE INVENTION

This invention relates to side bearings of the type for use in railroad vehicles. Such a side bearing ordinarily is a resilient, vibration-damping, energy-absorbing device positioned between a railroad car body and a truck bolster and adapted to be compressed under static preload forces and to absorb forces encountered as the car body swings in order to reduce the oscillating or "rolling" action of the car body with respect to its longitudinal center line and the "hunting" action of the wheel truck assembly, that is, the torsional oscillation of the wheel truck assembly about the point of attachment to the car body, thereby permitting higher operating speeds without derailment.

Side bearings have been known for many years employing rollers movably mounted in a frame supported on a truck bolster which could be contacted by the car body. Also, preloaded side bearings are known utilizing spring-loaded cam systems resulting in a complicated construction. Insofar as solving the problem of "rolling" oscillations resulting in derailments, it has been known to utilize snubber members used in conjunction with the spring groups between the truck bolster and the side frame of the truck. None of the foregoing, as well as other variations thereof, has been found to provide an inexpensive structure for the reduction of the "rolling" oscillations which cause the car bodies to sway from side to side, thereby creating the problem known in the railroad industry as "rock and roll".

U.S. Pat. Nos. 3,556,503 and 3,628,464 suggest using a resilient side bearing in the approximate shape of a frustum of a cone with a top surface having a sloping outer portion and made from a hard elastomeric material with a base, positioned between the railroad car body and a truck bolster, and adapted to be compressed under both static preloading forces and the alternating cycling loading forces generated by the "rolling" and "hunting" oscillations of the car under dynamic conditions. This device functions by absorbing the kinetic energy of the "rolling" and "hunting" and converting it into heat energy. I have found that under simulated, in-service conditions where the side bearing is made from a hard polyurethane elastomer, and the top surface has either a flat, medial portion with a sloping outer top surface portion, as described in U.S. Pat. No. 3,556,503, or a cylindrical axial bore with a metal insert, as described in U.S. Pat. No. 3,628,464, the distribution of the internal strain, is inefficient and causes undesirably rapid build-up of internal temperatures to between 250°F. and 400°F. and premature failure of the side bearing.

SUMMARY OF THE INVENTION

It is an object of the present invention, therefore, to provide a new and improved side bearing for railroad vehicles which avoids one or more of the above-mentioned disadvantages of such prior bearings.

It is another object of the invention to provide a new and improved side bearing which avoids an undesirable build-up of internal temperatures and premature failure.

It is another object of the invention to provide a new and improved side bearing capable of supporting a high preload, for example, 8,000 pounds and a high dynamic load, for example, ± 4,000 pounds applied sinusoidally at a rate of, for example, three cyles per second at ambient temperatures up to, for example, 120°F.

In accordance with the invention, a side bearing for railroad vehicles comprises an upstanding body portion of approximately frusto-conical shape, the upper bearing surface of the body portion being flat when the bearing is unloaded, a flanged base portion integrally formed on the lower end of the body portion, the body portion and the base portion being formed of an elastomeric material.

Also in accordance with the invention, a side bearing for railroad vehicles comprises an upstanding body portion of approximately frusto-conical shape and having a vertical axis, the upper bearing surface of the body portion being outwardly convex between the vertical axis and the perimeter of the body portion when the bearing is unloaded, a flanged base portion integrally formed on the lower end of the body portion, the body portion and the base portion being formed of an elastomeric material.

Also in accordance with the invention, a side bearing for railroad vehicles comprises an upstanding body portion of approximately frusto-conical shape and having a vertical axis, the upper bearing surface of the body portion being outwardly concave between the vertical axis and the perimeter of the body portion when the bearing is unloaded, a flanged base portion integrally formed on the lower end of the body portion, the body portion and the base portion being formed of an elastomeric material.

I have made the unexpected finding that the profile of the top surface of a frusto-conically shaped side bearing made from a hard elastomeric polyurethane material is a critical parameter in determining the efficiency of the distribution of internal strains and the extent of the build-up of internal temperatures. I have found in accordance with my invention that small changes in the profile of the top surfafce of the frusto-conically shaped side bearing exert unexpectedly large effects in the efficiency of the distribution of the strains and the concurrent build-up of internal temperatures.

The present invention provides a new and improved resilient, constant contact side bearing for the control of "rolling" and "hunting" oscillations of railroad cars. The side bearing is positioned between the frame of a railroad car and the truck bolster and preferably comprises a base member attachable to the truck bolster and a frusto-conically shaped vertical member extending from and contiguous with the base. The base and frustum portions are made from a hard, elastomeric polyurethane material using a casting technique wherein the base and frustum portions are formed in one piece. In one embodiment of this invention, the top surface of the frustum portion is a flat surface whose diameter is equal to the diameter of the top of the frustum and is parallel to the plane of the base. In a preferred embodiment of this invention, the side bearing has an axial bore extending from the top to the bottom plane of the base and the top surface has an outwardly concave profile. In another preferred embodiment of the invention, the side bearing has an axial bore extending from the top to the bottom plane of the base and the top surface has a convex or toroidal profile. In this last mentioned preferred embodiment, under a pre-load of 8,000 pounds and a dynamic loading of ± 4,000 pounds applied sinusoidally at 3 cycles per second, the maximum internal temperature build-up was 194°F. at an ambient temperature of 120°F.

For a better understanding of the present invention together with other and further objects thereof, reference is made to the following description, taken in connection with the accompanying drawings, and its scope will be pointed out in the appended claims.

DETAILED DESCRIPTION OF THE DRAWINGS

Figure 1:
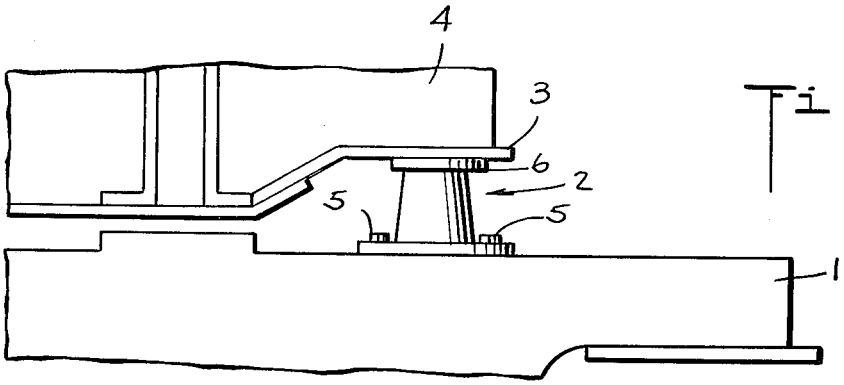
FIG. 1 is a fragmentary, simplified view of a portion of a railroad car body and truck bolster and a side bearing constructed in accordance with the invention therebetween.

Referring now more particularly to FIG. 1 of the drawings, to represent the utilization and the structure of the improved resilient, constant contact side bearing, the associated components of a railroad car 4 are shown in FIG. 1 wherein a truck bolster 1 underlies the car frame 3 with the side bearing 2 shown disposed therebetween and attached to the truck bolster 1 by bolts 5 and with the upper surface thereof in contact with a plate 6 secured to the underside of the car frame 3. When the car frame is assembled to the truck bolster, the parts are interfitted with the frame resting on the center plate of the truck bolster with the height of the side bearing 2 designed to provide for an initial deflection under a predetermined load. An initial contact load or preload of 8,000 lbs. may, for example, result in a deflection of the side bearing of approximately one-quarter of an inch A suitable elastomeric material for the side bearing has been found to be a polyurethane formed by mixing 100 parts of a liquid prepolymer, Vibrathane B-625, Vibrathane being a registered trademark of Uniroyal, Inc., with 17 parts of a diisocyanate curing agent, under trademark Curene 442, at an elevated temperature of 160°F. The B-625, which is obtainable from Uniroyal Chemical, a division of Uniroyal, Inc., is a polyether-MDI (4,4'-methylene di[phenylisocyanate]) prepolymer made from tetramethylene ether glycol having a molecular weight of 2,000, an isocyanate (—N=C=O) equivalent of 6.3% and a specific gravity of 1.05. The curing agent, Curene 442 is obtainable from Anderson Development Corporation and is 4,4'-methylene bis(2-chloroaniline). In practice, the Curene is first heated to 240°F. in order to melt it and is then added to the B-625 prepolymer which has been previously heated to 160°F. After rapid and thorough mixing, the mixture is poured into a suitable mold which has been heated to about 220°F. The cast side bearing with base and sleeves is given a temperature cure of one hour at 212°F. plus a post-cure of 24 hours at 158°F. The hardness of the elastomeric material is at least 95 Shore A.

Figure 2:
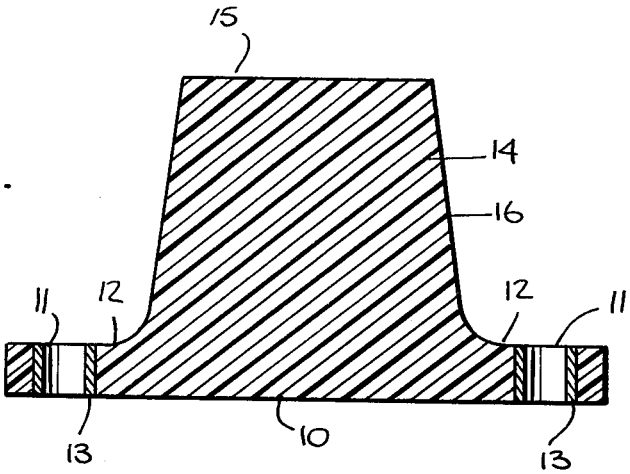
FIG. 2 is a central vertical sectional view of an embodiment of an unloaded side bearing constructed in accordance with the invention in which the upper bearing surface is a flat plane surface parallel to the plane of the bottom surface of the base.
Figure 3:
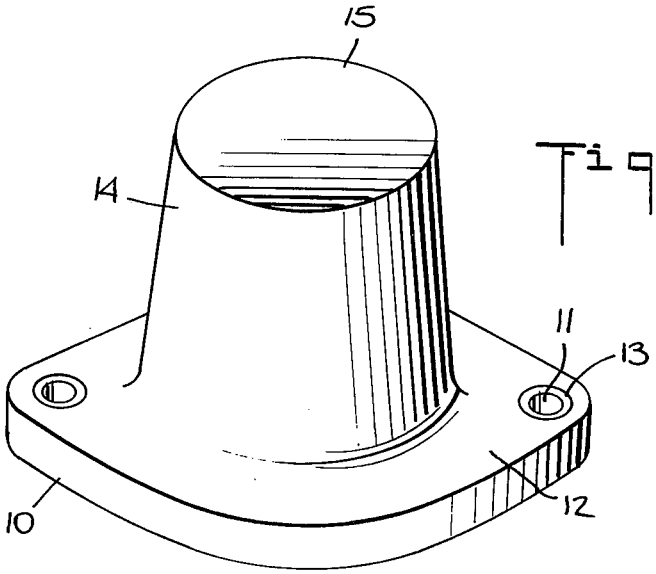
FIG. 3 is a perspective view of the side bearing of FIG. 2.

The embodiment represented in FIGS. 2 and 3 comprises an upstanding body portion 14 symmetrical about its central vertical axis and which has an approximately frusto-conical configuration with an integrally formed flanged base portion 10. The base 10 is provided with a pair of flanges 12 each containing an aperture 11 and reinforcing sleeve 13 for a bolt to fasten the side bearing to the bolster 1. The frusto-conical shape provides for maximum strength for the side bearing in the area where the body member 14 joins the base 10 to prevent roll-over of the side bearing in use. When the bearing is unloaded, the top surface 15 of the frustum-like body portion 14 is a flat surface whose plane is parallel to the plane of the bottom surface of the base 10. The flat top surface 15 distributes the static preload and dynamic cyclic loading over the whole top surface area and, therefore, uses the total mass of the body member at high efficiency while maintaining the desired deflection characteristics.

Figure 4:
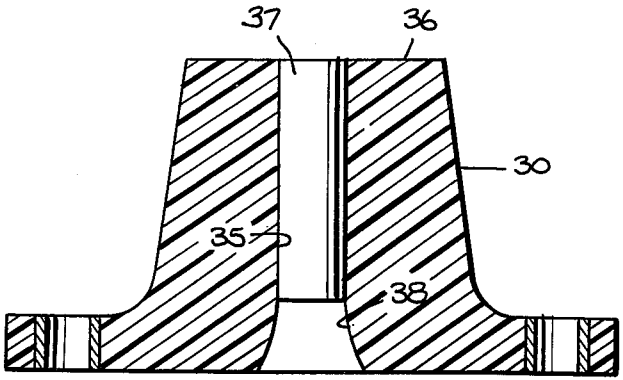
FIG. 4 is a central vertical sectional view of an embodiment of an unloaded side bearing constructed in accordance with the invention in which the upper bearing surface is a flat plane surface parallel to the plane of the bottom surface of the base and which bearing has a central vertical aperture therein in which a rod may be seated.

The device represented in FIG. 4 is of similar size and shape as the embodiment shown in FIGS. 2 and 3. However, the main body member 30 is provided with a cylindrical opening or bore 35 along its central vertical axis and extending axially from the uppermost surface 36 to the bottom surface of the base where it flairs part of the way to provide a flaired opening 38. The opening 35 is preferably 1¼ to 1½ inches in diameter and the overall height of the bearing is preferably 5¾ inches.

A cylilndrical metal rod 37 having a diameter of 1¼ to 1½ inches and a length of approximately 4½ inches may be optionally included as shown in FIG. 4, where it is desired to restrict the maximum compression and deflection of the bearing, under maximum loading conditions, by causing the railroad car frame, in effect, to bottom the rod 37. The rod 37, which is frictionally seated in the bore 35, also functions as a safety stop to limit tilting of the railroad car frame.

Figure 5:
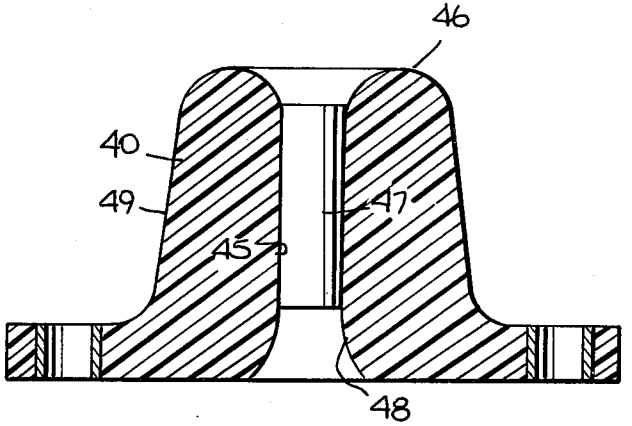
FIG. 5 is a central vertical sectional view of an embodiment of an unloaded side bearing constructed in accordance with the invention in which the upper bearing surface is shaped like a portion of a toroid and which bearing has a central vertical aperture therein in which a rod may be seated.

The side bearing represented in FIG. 5 is of generally similar size and shape as the embodiments shown in FIGS. 2, 3 and 4. The main body member 40 is provided with a cylindrical opening or bore 45 along its central vertical axis and extending axially from the uppermost surface 46 to the bottom surface of the base where it flares part of the way to provide a flared opening 48. The opening 45 may preferably be 1¼ to 1½ inches in diameter and the overall height of the bearing may preferably be 5¾ inches.

A cylindrical metal rod 47 having a diamter of 1¼ to 1½ inches and a length of approximately 4½ inches may be optionally included as represented in FIG. 5, where it is desired to restrict the maximum compression and deflection of the bearing under maximum loading conditions by causing the railroad car frame, in effect, to bottom the rod 47. The rod 47, which is frictionally seated in the bore 45 also functions as a safety stop to limit tilting of the railroad car frame.

Unlike the embodiments represented in FIGS. 2, 3 and 4, the top surface of the main body portion of the FIG. 5 embodiment has a toroid-like convex surface 46 which at the inside end is contiguous with the wall of the cylindrical bore 45 and at its outer end is contiguous with the sloping wall 49 of the main body member 40. The curvature of the surface 46 is symmetrical with respect to the uppermost line of the convex surface 46. The sloping of the upper surface 46 of the side bearing permits a limited amount of the elastomeric material to compress under the force of the static pre-load which along with the cyclic load becomes distributed relatively evenly over the whole mass of the body member 40. The radius of the convex curvature 46 preferably is approximately ½ the width of the main body member 40 at the upper end of the sloping wall 49. The width of the main body member 40 at the upper end of the sloping wall 49 may be, for example, 4½ inches and at the lower end of the sloping wall 49 may be, for example, 5½ inches.

Figure 6:
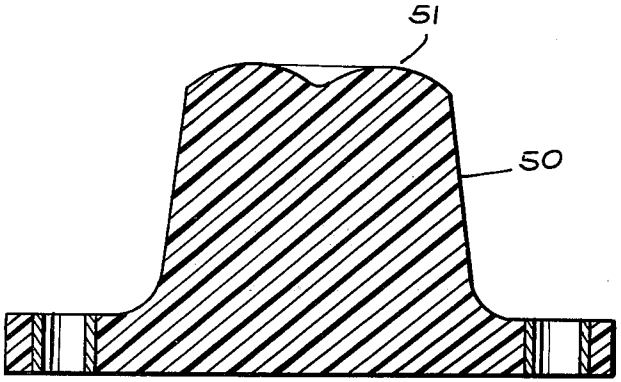
FIG. 6 is a central vertical sectional view of an embodiment of an unloaded side bearing constructed in accordance with the invention in which the upper bearing surface is outwardly convex between the vertical axis and the perimeter of the body portion of the bearing when the bearing is unloaded.

FIG. 6 represents a side bearing 50, in accordance with the invention, generally similar to the FIG. 5 embodiment but having no axial vertical aperture therein and having an upper bearing surface 51 which is outwardly convex between the vertical axis and the perimeter of the body portion when the bearing is unloaded but which is of smaller height than the outwardly convex outer bearing surface of the FIG. 5 embodiment. The convex curvature of the FIG. 6 embodiment is substantially symmetrical with respect to the uppermost line of the convex surface.

Figure 7:
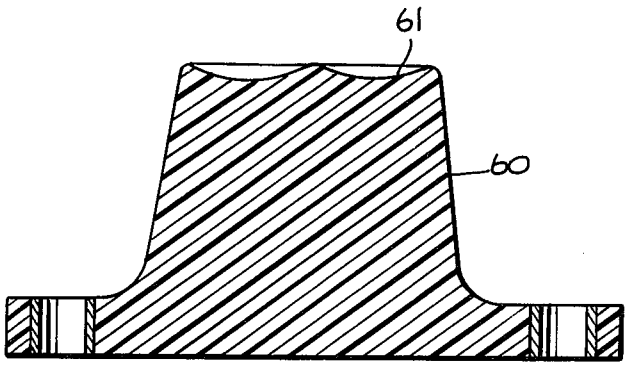
FIG. 7 is a central vertical sectional view of an embodiment of an unloaded side bearing constructed in accordance with the invention in which the upper bearing surface is outwardly concave between the vertical axis and the perimeter of the body portion of the bearing when the bearing is unloaded.

FIG. 7 represents a side bearing 60, in accordance with the invention, generally similar to the FIG. 6 embodiment but having an upper bearing surface 61 which is outwardly concave between the vertical axis and the perimeter of the body portion when the bearing is unloaded. The concave curvature of the FIG. 7 embodiment is substantially symmetrical with respect to the lowermost line of the concave surface.

Figure 8:
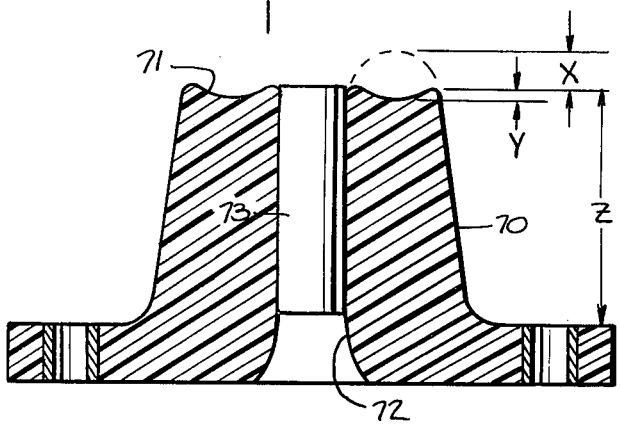
FIG. 8 is a vertical sectional view of a preferred embodiment of an unloaded side bearing constructed in accordance with the invention in which the upper bearing surface is outwardly concave between the vertical axis and the perimeter of the body portion when the bearing is unloaded and which bearing has a central vertical aperture therein in which a rod may be seated in the aperture.

FIG. 8 represents a side bearing 70 generally similar to FIG. 7 embodiment with a concave top surface 71 but having a vertical aperture 72 therein along its central vertical axis similar to that of FIG. 4 embodiment in which a cylindrical metal rod 73 similar to that of the FIG. 4 embodiment may be optionally included. The concave surface 71 is substantially symmetrical with respect to the lowermost line of the concave surface. The broken line curve of the FIG. 8 embodiment represents the curvature of the top surface 46 of the FIG. 4 embodiment so that the ranges of curvature of convex and concave surfaces can be compared. I have determined that for satisfactory performances, the geometry of the cross-section of an individual side bearing should be within the following limits, referring to FIG. 8:

A. For the convex configuration:

$0 \leq X/Z \leq 1/5;$

B. For the concave configuration:

$0 \leq y/Z \leq 1/15.$

In the FIG. 8 embodiment, the height of the bearing represented by the dimension $Z$ preferably is 4⅛ inches, the depth of the concave top surface, represented by the dimension $y$ preferably is 0.175 inch with the arc of the concave surface swung on a 1.09 inch radius. The arcs at the edges of the top surface preferably are swung on ¼ to ½ inch radii to curve the edges slightly. The central aperture or bore preferably has a diameter of 1¼ to 1½ inches. The width of the main body member at the upper end of the sloping wall preferably is 4½ inches. The width of the main body member lower end of the sloping wall preferably is 5½ inches.

In order to demonstrate the superior performance of the embodiments of this invention over the prior art devices, the internal strain distribution was studied on side bearings fabricated in accordance with U.S. Pat. No. 3,628,464 and also the embodiments of this invention. These studies were conducted by embedding conventional strain gauges in the elastomeric side bearing during the casting process. To facilitate the embedding process, the hollow bore configuration was used. Four configurations were tested as follows:

1. Conical top bearing in U.S. Pat. No. 3,628,464, FIG. 4 but with a central bore and no central rod;

2. Flat top embodiment in accordance with the teachings of this invention as shown in FIG. 4 hereof but with a central bore and no central rod;

3. Toroidal top embodiment in accordance with the teachings of this invention, as shown in FIG. 5 hereof but with a central bore and no central rod;

4. Dished (or concave) top embodiment in accordance with the teachings of this invention, as shown in FIG. 8 hereof, with a $y/Z$ ratio of approximately 0.04.

Figure 9:
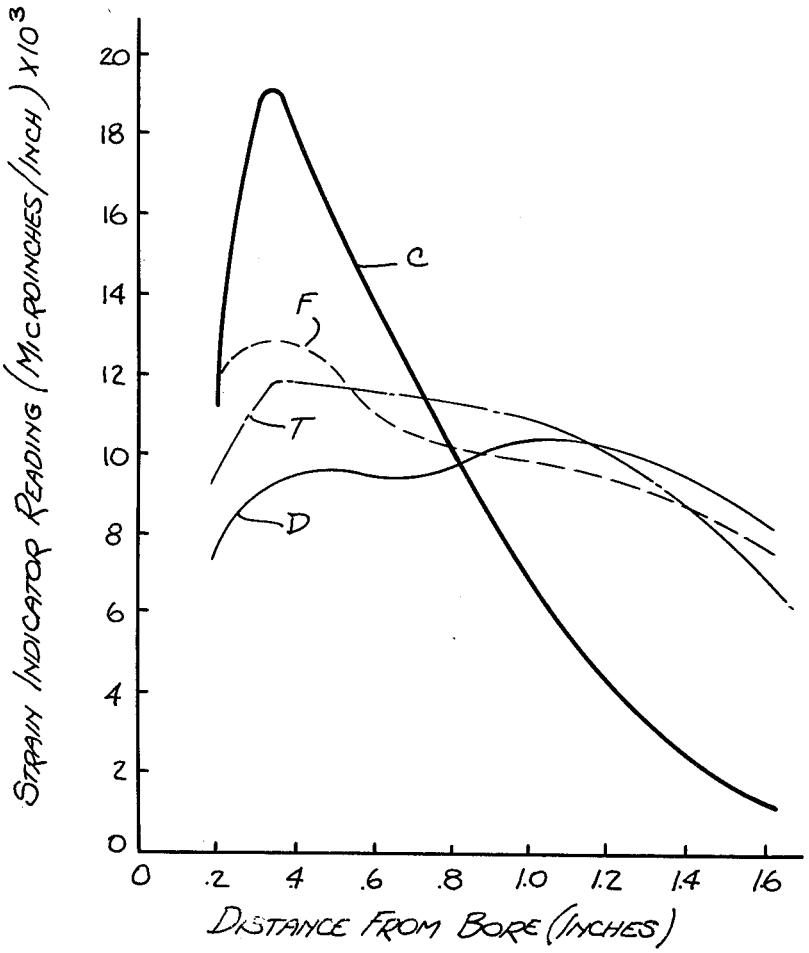
FIG. 9 is a graph representing the internal radial strain distribution of a side bearing of the prior art and of side bearings constructed in accordance with the invention.
Figure 10:
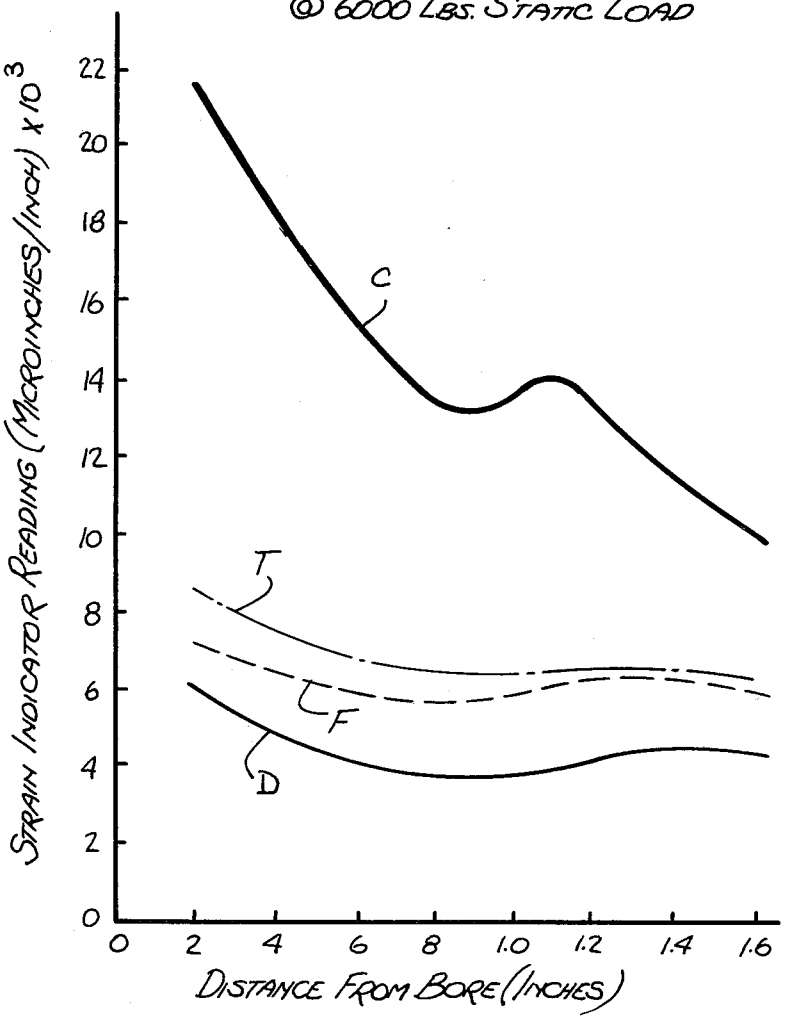
FIG. 10 is a graph representing the internal tangential strain distribution of a side bearing constructed in accordance with the prior art and of side bearings constructed in accordance with the invention.
Figure 11:
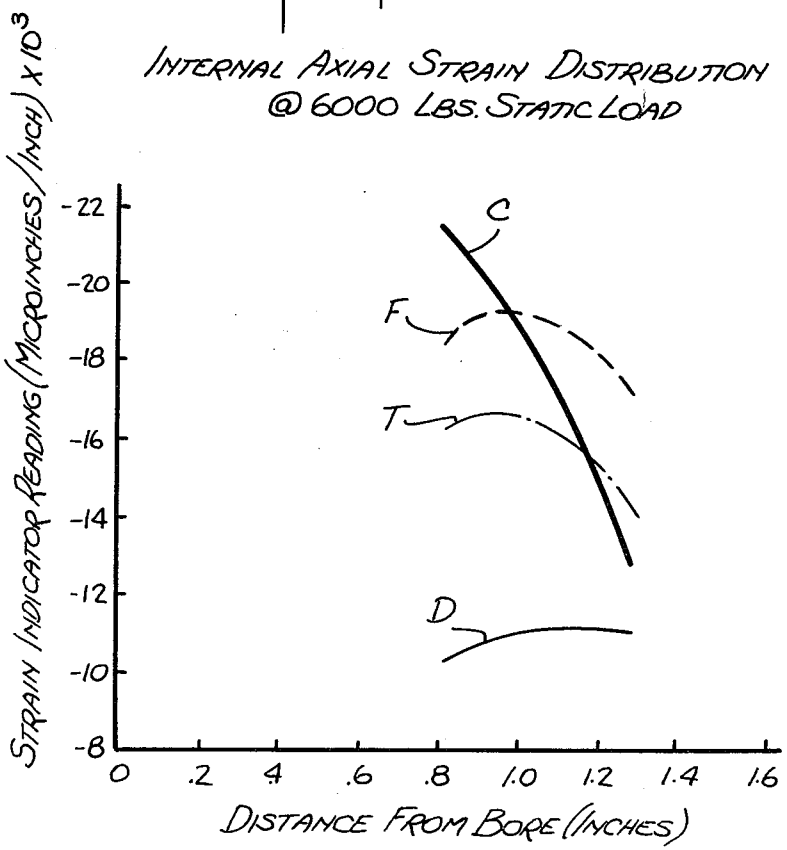
FIG. 11 is a graph representing the internal axial strain distribution of a side bearing constructed in accordance with the prior art and of side bearings constructed in accordance with the invention.

The four bearings were tested using incremental compression loads. For comparison purposes, the strain distributions at 6,000 lbs. in the radial, tangential and axial directions are shown in FIGS. 9, 10 and 11 wherein curves C, F, T and D represent, respectively, the strain in micro inches/inch at distances from the edge of the bore in inches for the conical top, flat top, toroidal top and dished top bearings described above.

Comparing the radial and tangential strains, it is evident that the distribution throughout the cross section is much more uniform for the flat top, toroidal top and dished top bearings. This results in substantially lower peak strain magnitudes for the flat, toroidal and dished top embodiments. Comparing the limited axial strain data, it should be noted that in addition to lower peak strain magnitudes in the flat, toroidal and dished top embodiments the trend of the curves is also substantially improved. The data indicates a continued increase in the axial strain toward the bore in the conical top bearing whereas the flat, toroidal and dished top bearings appear to achieve the peak axial strain values near the center of the wall thickness.

It should further be noted that all of the strains for the bearing of U.S. Pat. No. 3,628,464 increase toward the bore at a very rapid rate and that the magnitudes are higher than those obtained for the flat, toroidal and dished top embodiments. Laboratory testing of U.S. Pat. No. 3,628,464 bearings revealed failures due to localized heat build-up at the bore. The failure was evidenced by the formation of a localized internal cusp at the bore and permanent set. Similar dynamic laboratory studies for the flat top and toroidal top bearings showed a definite leveling off of the internal temperature at acceptable levels with no permanent set.

It is also apparent that the dished or concave top surface bearing is superior to the other three types of bearings. Not only is the strain distribution more uniform but the magnitude of the strain is the lowest. With respect to the distribution of internal radial strain, there is an unexpected reversal of the rate of change (slope) of distribution going from the exterior to the inner wall of the bore in the region of .6 inch distance from the bore. With respect to the distribution of internal axial strain, there is an unexpected reversal of the rate of change of distribution in the flat top, toroidal top and dished top embodiments. These reversals are highly advantageous from the point of view of attenuating heat build-up at the inner wall under dynamic conditions.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

I claim:

1. A side bearing for railroad vehicles comprising an upstanding body portion of approximately frusto-conical shape and having a vertical axis, the upper bearing surface of said body portion being outwardly convex between said vertical axis and the perimeter of said body portion when the bearing is unloaded, the bearing having a vertical cross section with an upper surface convexity having a vertical center line positioned on each side of said vertical axis and between said vertical axis of the bearing and said perimeter of said body portion when the bearing is unloaded, a flanged base portion integrally formed on the lower end of said body portion, said body portion and said base portion being formed of an elastomeric material.

2. A side bearing in accordance with claim 1 in which said elastomeric material is a polyurethane material.

3. A side bearing in accordance with claim 1 in which said convexity center line is positioned substantially midway between said vertical axis of the bearing and said perimeter of said body portion when the bearing is unloaded

4. A side bearing in accordance with claim 1 which has an aperture extending through said body portion and said base portion along said vertical axis.

5. A side bearing in accordance with claim 4 which has a rod having a length less than the length of said aperture seated in said aperture.

6. A side bearing in accordance with claim 4 in which said convexity center line is positioned substantially midway between the boundary surface of said aperture and said perimeter of said body portion when the bearing is unloaded.

7. A side bearing for railroad vehicles comprising an upstanding body portion of approximately frusto-conical shape and having a vertical axis, the upper bearing surface of said body portion being outwardly concave between said vertical axis and the perimeter of said body portion when the bearing is unloaded, the bearing having a vertical cross section with an upper surface concavity having a vertical center line positioned on each side of said vertical axis between said vertical axis of the bearing and said perimeter of said body portion when the bearing is unloaded, a flanged base portion integrally formed on the lower end of said body portion, said body portion and said base portion being formed of an elastomeric material.

8. A side bearing in accordance with claim 7 which has a rod having a length less than the length of said aperture seated in said aperture.

9. A side bearing in accordance with claim 7 in which said elastomeric material is a polyurethane material.

10. A side bearing in accordance with claim 7 in which said concavity center line is positioned substantially midway between said vertical axis of the bearing and said perimeter of said body portion when the bearing is unloaded.

11. A side bearing in accordance with claim 7 which has an aperture extending through said body portion and said base portion along said vertical axis.

12. A side bearing in accordance with claim 11 in which said concavity center line is positioned substantially midway between the boundary surface of said aperture and said perimeter of said body portion when the bearing is unloaded.

* * * * *